US005097635A

United States Patent [19]

Beasley

[11] Patent Number: 5,097,635

[45] Date of Patent: Mar. 24, 1992

[54] METHOD AND APPARATUS FOR AUTOMATIC BALL TO SEAT LAPPING

[75] Inventor: Marvin E. Beasley, Houston, Tex.

[73] Assignee: Keystone Valvtron, Inc., Houston, Tex.

[21] Appl. No.: 563,085

[22] Filed: Aug. 6, 1990

[51] Int. Cl.[5] ..... B24B 15/04

[52] U.S. Cl. ..... 51/241 VS; 51/281 R

[58] Field of Search ..... 51/241 VS, 241 R, 58, 51/281 R, 317

[56] References Cited

U.S. PATENT DOCUMENTS 4,216,626 8/1980 Starp ..... 51/58

4,704,824 11/1987 Horner ..... 51/281 R

FOREIGN PATENT DOCUMENTS 0158690 2/1983 Fed. Rep. of Germany ..... 51/241 VX

*Primary Examiner*—Roscoe V. Parker

[57] ABSTRACT

Disclosed is a new and improved method and apparatus for automatically lapping a ball and a seat of a valve to produce a non-flat lapped sealing surface finish that provides a reliable fluid seal at minimum cost. Either the seat or ball is rotated as the work piece by the apparatus while in contact with the surface of a lap member which may be the mating seal part. The lap member is held or maintained in a desired angular or tilt relationship with the work piece. A controllable force spring is provided to maintain the desired lapping force between the work piece and lap member. While the lap member is blocked from rotation about the tilt angle and apparatus swings or oscillates the lap member about the work piece to maximize the effectiveness of the lapping contact.

25 Claims, 3 Drawing Sheets

FIG.1
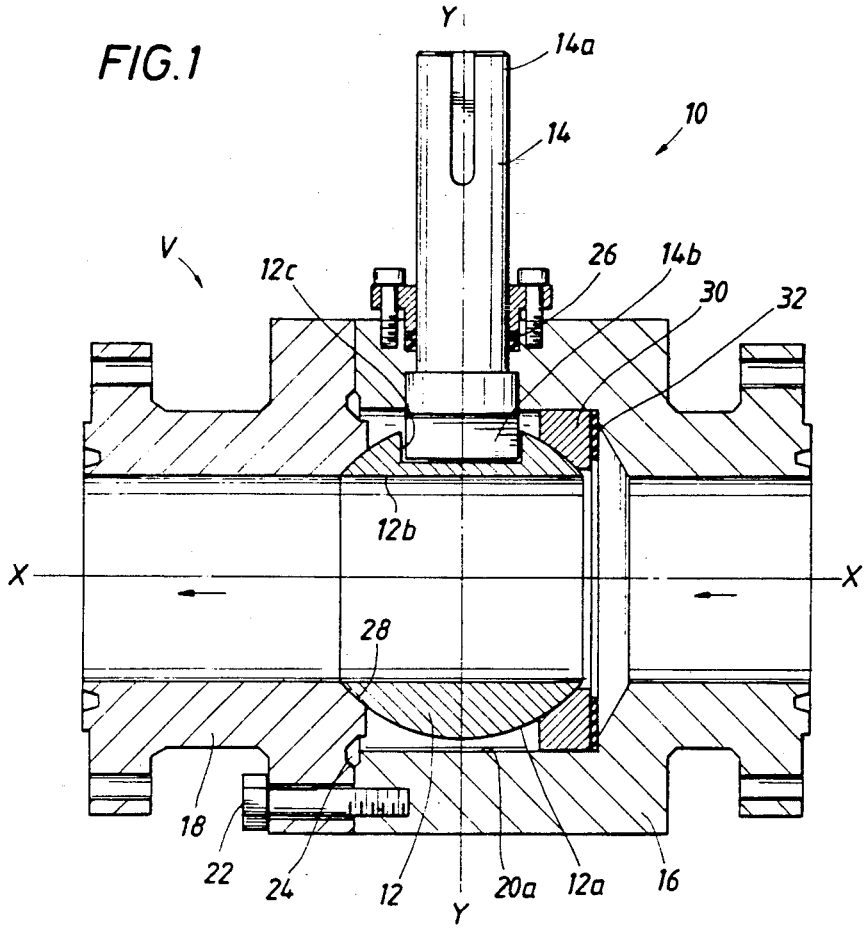
FIG.2
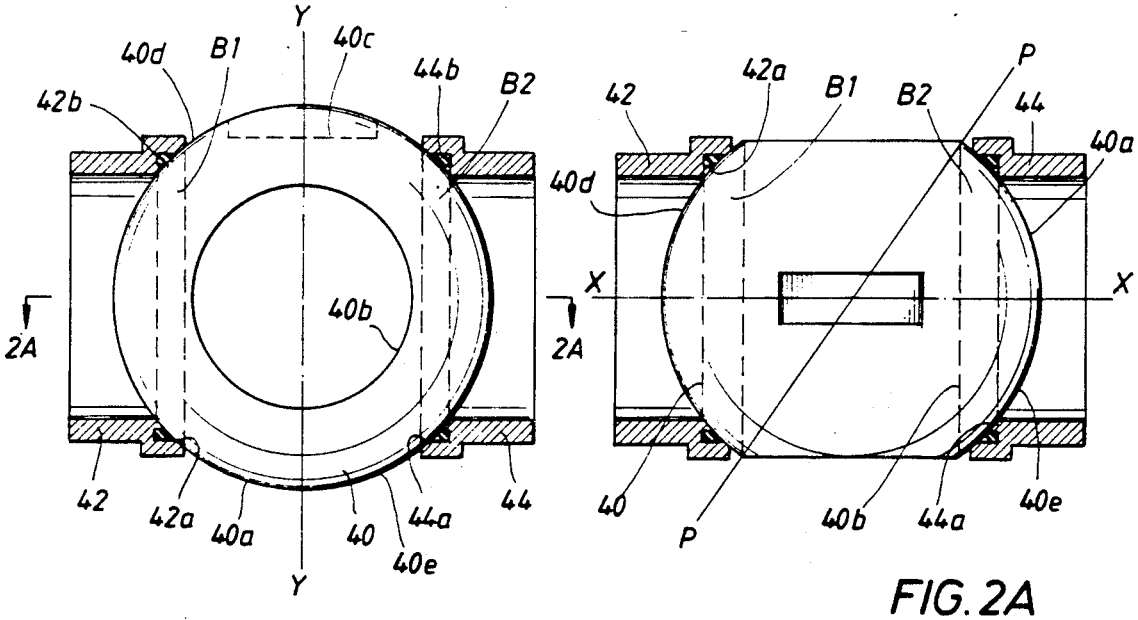
FIG.2A

FIG. 3
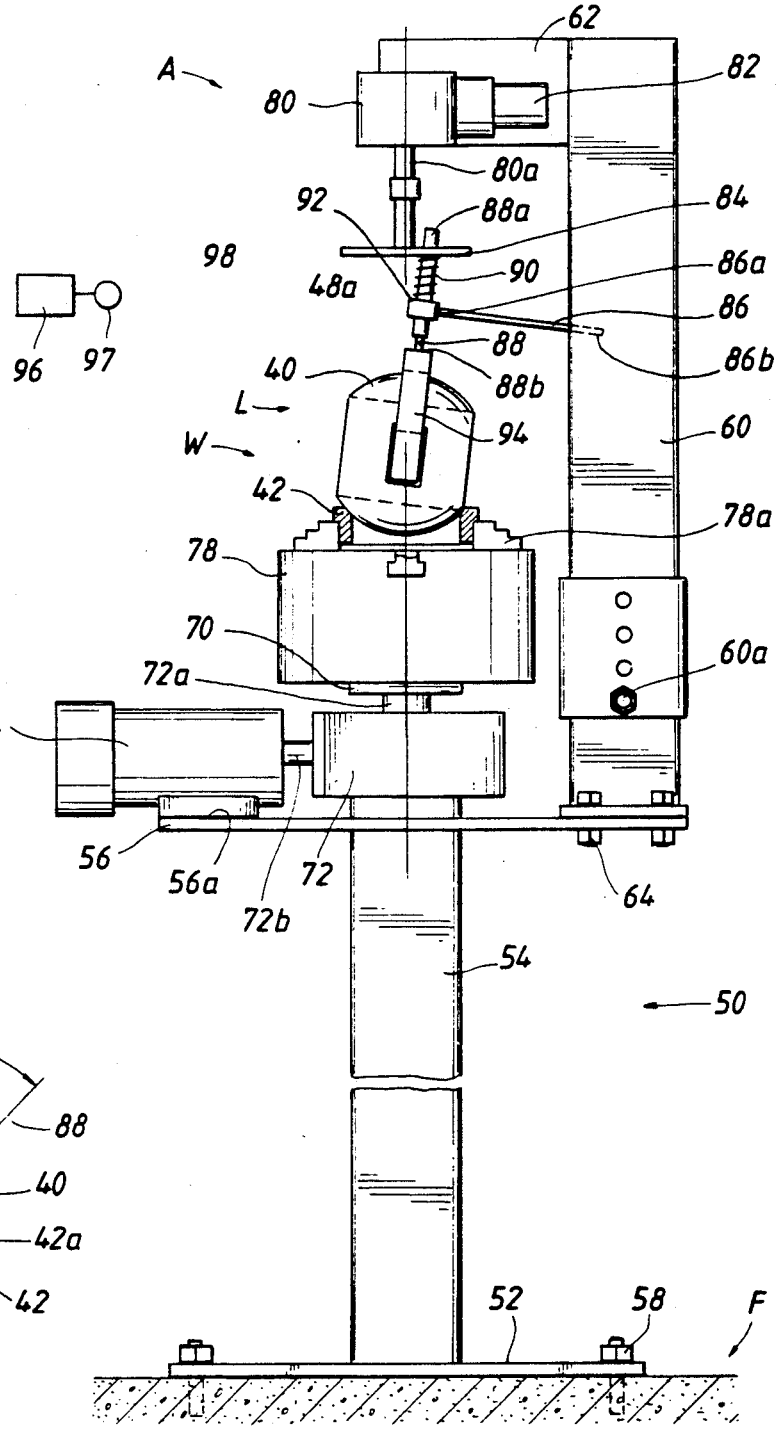
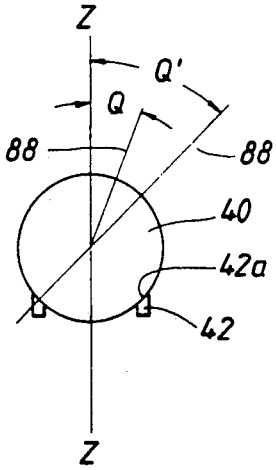
FIG. 7
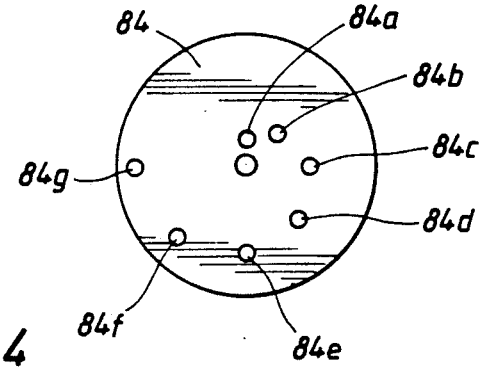
FIG. 4

FIG.5
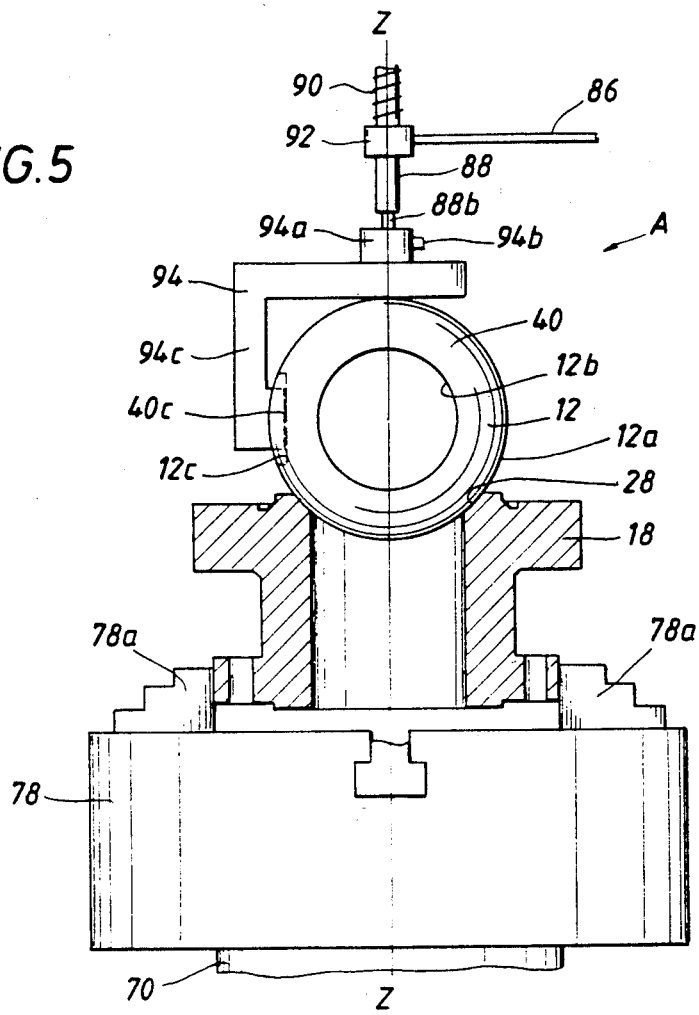
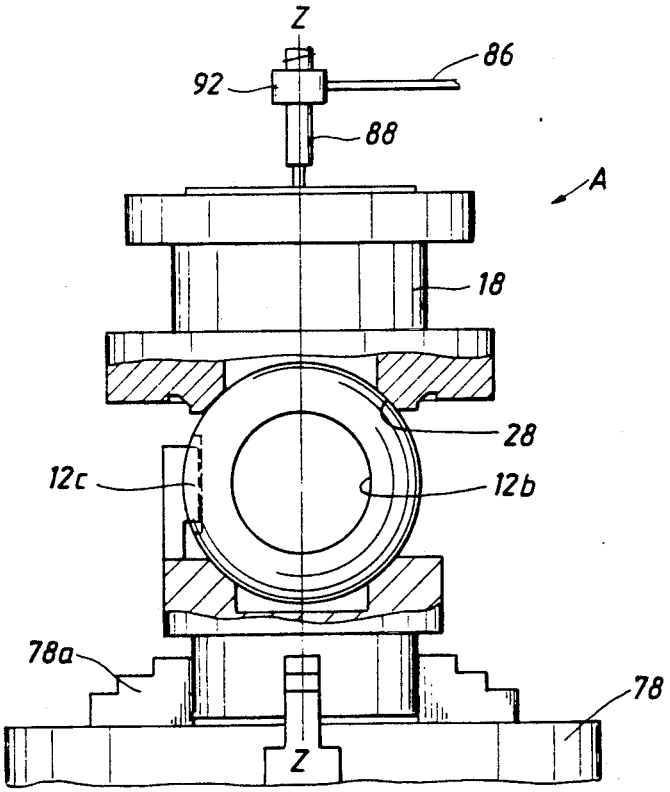
FIG.6

METHOD AND APPARATUS FOR AUTOMATIC BALL TO SEAT LAPPING

(b) CROSS-REFERENCES TO RELATED APPLICATIONS

NONE

(c) BACKGROUND OF THE INVENTION

1. Field of Invention

This invention relates to the field of surface finishing by lapping and more particularly to the field of an automatic ball to seat lapping method and apparatus.

2. Description of the Related Art

A production surface finishing process, commonly known to those skilled in the art as lapping, is used to provide a very smooth finish on various desired surfaces. Normally, lapping is associated with metal working or surface finishing of parts made of metals, but is not necessarily so limited. The smoothness of a surface finish is usually expressed in terms of surface roughness although the terms are often considered to be interchangeable. With known production lapping processes a surface roughness or finish in the range of 2 to 8 microinches, root mean square (rms) may be reliably achieved. As a relative guide to this surface finish measurement scale, a mirror normally has a surface roughness of 1 rms while the finest machined metal surfaces are finished in the range of 32 to 63 rms. As a surface roughness of 32 rms is more than adequate for most parts, surface treatment by lapping is normally utilized only on critical surfaces.

There are many devices and methods of measuring surface roughness known to those skilled in the art. Roughness measurements are usually expressed in microinches, either the mean arithmetic deviation from the average surface or the root mean square (rms), where a microinch is one millionth of an inch (0.000 001 or $10^{-6}$ in.).

As would be expected, the smoother the desired metal surface finish, the more expensive it is to obtain. And under the economic rule of the cost of diminishing returns, the last increment of surface roughness removed or smooth surface finish obtained greatly escalates the cost. The lapping process does not remove much metal or greatly change the dimensions of a part. Accordingly, the surfaces of parts to be finished by lapping are normally shaped very close to final tolerances before lapping begins to minimize the costs of lapping. Nevertheless, parts required to be finished by lapping are relatively expensive to manufacture.

While the lapping process may take a number of forms depending on the surface geometry of the parts involved, it is generally understood to require physical contact with relative motion, usually rotational, between the work piece or part being finished and a mating member, usually identified or called either a lap member or simply a lap, in the presence of a suitable lapping abrasive. The lap member may be either a special tool or the mating part itself. If the mating part is used as the lap member the two parts are considered to be dedicated or mate lapped together for final assembly purposes and are not thereafter considered interchangeable for assembly with others of the same type or part. Frequently, the special tooling lap member will be used initially for performing the course or rough lapping with the mating part being substituted as the lap member during the final precision stage of lapping. As used herein, lap or lap member will include either the mating part or special tooling lap.

A lapping fluid, usually liquid, having fine abrasive lapping particles suspended therein is continuously circulated between the lap and surface of the part being finished for lubrication and cooling. A predetermined lapping contact pressure is then applied to effect removal of the high spots of the part or parts having the surface being lapped. Due to the nature of the lapping process, this pressure is usually restricted to a low value to provide the desirable smooth finish. Because lapping time is related to the size of the abrasive particles and the contact pressure exerted, the metal removal process is slowly accomplished that further adds to the cost involved.

Production machines for lapping flat surfaces are well known and can achieve the normal highly polished, lapped range of surface finish with a flatness normally measured in helium light bands. Flat lapping machines are highly useful in forming flat fluid sealing metal surfaces for mechanical seals or flat metal-to-metal sealing surfaces or seats for certain types of gate valves. Their usefulness in forming fluid sealing seats in other types of valves has previously been limited due to the non-flat geometry of the sealing faces involved. Non-flat surface lapping has been in large part a manual operation.

Rotatable ball valves, as spherical plug valves are commonly known, are highly desirable for a number of reasons. They are quickly actuated (by a quarter turn of the metal ball flow closure element) between the open and closed position and provide a large, unobstructed central fluid flow passage through the valve and ball opening in the open condition or position. An additional advantage is the annular sealing area or arcuate face of the metal valve seat ring surrounding the central flow passage is protected from flow caused damage by continuous contact with the generally spherical outer surface of the ball in both the valve open and closed positions. This latter advantage is highly desirable in valve service where the fluid being controlled contains solid particles that abraded the seal surfaces.

Because of the cost and manufacturing difficulty in effecting a reliable metal-to-metal spherical contact annular fluid seal, such valve seat rings have usually been provided with a much more tolerant annular seal provided by a protruding soft resilient annular seal ring concentrically carried by the metal seat ring for contacting the ball. See for example, Tomlin U.S. Pat. No. 3,784,155. Such primary resilient soft seats are normally made of teflon, nylon or other polymeric material which limits the upper temperature range at which the rotatable ball valve will reliably seal. To assure fluid sealing operation in the event of a fire that will destroy the primary polymer soft seat, a normally inactive back up or secondary metal-to-metal, annular seal face may be provided on the seat ring for such emergency. Various published codes and standards also require such secondary metal-to-metal seats in rotatable ball valves.

The primary (or secondary) face seal of any rotatable ball valve is achieved by metal-to-metal contact between the arcuate or spherical shaped annular face of the valve seat and the outer spherical surface of the ball. This seal must be formed throughout the annular contact area as leakage will occur at any point not properly in sealing contact. To achieve this uniform metal contact for sealing, both the seat and ball surface must be finished to a high degree of smoothness and accuracy.

To achieve a reliable primary or secondary metal-to-metal seal between the spherical outer surface of the ball and the annular arcuate seat face, a very expensive manual or hand manipulated lapping process has commonly been employed. Such manual lapping operations produces erratic results as to the quality, uniformity and reliability of the fluid seal obtained and as to the time in which it is achieved; both are dependent on and functions of the skill of the person doing the manual lapping. For example, as the most highly skilled operator tires the lapping force or contact pressure is normally reduced or diminished and thereby increasing the lapping time.

To avoid the cost or expense of lapping rotatable ball valves having a primary or secondary metal-to-metal seal, various seat ring design approaches have been taken. For example, in Pennington U.S. Pat. No. 3,392,743, flexible annular metal sealing lips are provided on the seat rings to effect the annular primary metal-to-metal sealing engagement with the rotatable ball member. See also U.S. Pat. No. 4,126,295, to Natalizia for another variation of a rotatable ball valve where the entire metal seat ring is deformable.

Numerous automated approaches have been undertaken for enhancing spherical surface finish of a ball or spherical member. U.S. Pat. No. 537,071 to Fuller discloses an apparatus for polishing spherical balls, but not to achieve a metal-to-metal fluid seal with a mating seal of a valve.

Newman et al U.S. Pat. (No. 1,131,611) discloses a ball-to-seat lapping or grinding machine for single direction or ball check valve used in certain types of pumps. Unlike rotatable ball valves, the fluid sealing contact of the solid ball of a ball check valve is randomly positioned on the annular seat ring for sealing. This requires the entire spherical surface of the ball to be finished by mate lapping for effecting a desired fluid seal. The annular seal face of the seat ring is spring biased against the freely rotating solid ball during the mate lapping operation to obtain an accurate mate fit for fluid sealing on the spherical surfaces. No angular or other adjustment in position of either the seat or ball is provided during mate lapping.

U.S. Pat. No. 1,806,918 to Riggs is entitled "VALVE SEAT LAPPING MACHINE" and discloses an apparatus for simultaneously lapping solid balls and seats for ball valves. Two pairs of seats or collars are simultaneously lapped to a single solid ball employing a spring biasing on one seat to restrain the ball between the two seats. The seats are rotated on the relative angled axes provided by the shafts carrying the seats against the unrestrained or freely floating solid ball which is located between the rotating seats. The resulting outer surface motion of the ball is uncontrolled requiring a reversal or switch in position of the seat rings that doubles the lapping time required.

The patent to Capps U.S. Pat. (No. 1,950,785) also discloses a valve ball-to-seat lapping apparatus having an angular adjustment between the ball and the two rotating seats. The apparatus includes two opposed headstocks, each having a rotor upon which an inclined rotatable shaft is mounted. A seat is mounted on each shaft in a facing relationship for supporting the solid ball therebetween. The angular position or relationship of the two rotating seats is continuously changed to move the seats over all surface portions of the solid ball by a wobble motion. While the center of the ball is continuously fixed at the vertex of the changing seat angles and thus remains stationary the diameter ball spherical surface is free of any movement restraint. Motion of the two inclined shafts describe cones having vertexes aligned with shafts 8. As also disclosed in Capps the lapping operation for a ball and mating seat is commonly a manual activity with the ball pressed against the seat by the fingers of the workman.

In U.S. Pat. No. 2,075,216 to Mancuso multiple solid balls and seat rings are simultaneously lapped into a fluid-tight sealing relationship. This is achieved by an apparatus mounting a seat rings or seats in one of the plurality of chucks carried by a corresponding plurality of spindles. The solid ball is then positioned between the seat and the resilient tractive surface of the turntable and the spindle springs actuated. The turntable and planetary head are then selectively rotated to preferably mate lap the ball and seats. A planetary motion is given to the valve seat carried by the rotating spindle while insuring rotation of the ball. A yieldingly urging means or spring on the spindle urges the valve seats into lapping relation with the mated ball to obtain an even and accurate lapping. The ball is held in engagement with the seat by a flat tractive surface material carried on the rotating turntable which also imparts free lapping rotation to the ball.

Lichtenfeld U.S. Pat. No. 3,050,910 discloses a conventional rotating table flat lapping machine having a rotating flat lapping turn surface or plate 10. The parts having the flat surface to be lapped ar held against rotational movement with the table and are provided with a rotating or oscillatory movement relative to the table by rotating rings or lapping pots to obtain the desired flat lap surface.

The automatic flat lapping machine disclosed in Harris et al U.S. Pat. No. 3,111,791 is similar to and related to that of the Lichtenfeld patent discussed above. A counter rotation motion is induced in the work piece held in the lapping pots.

U.S. Pat. No. 3,111,789 to Harmon is entitled "SPHERE LAPPING MACHINE" and discloses apparatus for forming a precision gyroscope ball used in inertial navigational systems. The resulting ball is periodically tested for static balance, sphericity and diameter tolerances, but not for sealing or mate lapping with a valve seat. The solid sphere or ball is angularly supported by a pair of spring biased rotating work holders arranged on an intersecting axis that intersect at the center of the ball. To insure randomized lapping of the entire ball the vertical head shaft 13 angularly mounts the second shaft 22 carrying axially adjustable cast iron concave machine tool lap member for shaping the sphere. The lap 27 is continually driven in complex rotation about axis of shafts 13 and 22. Rotation of shaft 13 also rotates the angled shaft 22 about the ball while rotation of the shaft 22 simultaneously imparts a rotation to the lap.

The patent to Okano et al U.S. Pat. (No. 4,114,323) discloses a "DEVICE FOR AUTOMATICALLY LAPPING WEDGE-GATE VALVE SEATS". The resulting lap surfaces effecting the fluid seal are flat and not spherical.

U.S. Pat. No. 4,468,158 to Pearce et al discloses an apparatus for in place refinishing of the sealing surfaces of a top entry or loaded ball valve. During operation separate sealing rings are positioned in contact with the ball. The disclosed apparatus does not mate lap the ball to the refinished seat or shim for the seat rings.

(d) SUMMARY OF THE INVENTION

The present invention relates to the field of surface finishing by lapping and more particularly to the field of an automatic ball to seat lapping method and apparatus.

The new and improved apparatus includes a support frame, means for rotatably supporting a work piece to be lapped, means for rotating the work piece and means for selectively supplying the lapping fluid having the abrasive particles. The apparatus further includes a lap member having a lap surface that is placed and held in lapping contact with the work piece at any adjustable lapping angle. The position of the lap member is continuously varied by a swinging or oscillating relative to the work piece to form a desired lapped sealing surface. The apparatus further includes adjustable biasing means for controlling the lapping contact force between the lap and work piece during lapping to ensure uniform coverage.

The method includes steps of positioning the rotatable work piece to form a lapping reference axis, rotating the work piece and holding the lap member at a predetermined angle while moving the lap member in a specified manner.

An object of the present invention is to provide a new and improved method and apparatus for metal finishing by lapping.

Another object of the present invention is to provide a new and improved method and apparatus for automatic ball to seat lapping.

Yet another object is to provide a new and improved method and apparatus for forming a mate lapped metal-to-metal fluid seal between a ball and a seat.

One further object is to provide a new and improved method and apparatus for forming a lapped bond on a ball that effects a metal-to-metal fluid seal with a seat.

(e) BRIEF DESCRIPTION OF THE DRAWING

FIG. 1 is a side view, in section, of a preferred form of a metal seated rotatable ball valve produced in accordance with the present invention.

FIG. 2 is a side view, partially in section, illustrating the sealing relationship of the seat and the ball when in the closed position of another ball valve produced in accordance with the present invention.

FIG. 2A is section view taken along lines 2A—2A of FIG. 2.

FIG. 3 is a side view, of one form or embodiment of the ball-to-seat lapping apparatus of the present invention.

FIG. 4 is a top view of the coupling disk of the lapping apparatus of the present invention.

FIG. 5 is a side view, partially in section of the lapping apparatus of the present invention.

FIG. 6 is a side view, partially in section, of the lapping apparatus of the present invention.

FIG. 7 is a partial view showing the relationship of the lapping angle to the reference lapping axis.

(f) DESCRIPTION OF THE PREFERRED EMBODIMENT

While the present invention is especially suited to the utility or useful purpose of forming either primary or secondary metal-to-metal seals for rotatable ball valves, it is to be understood that the present invention is not to be considered to be limited to only that application. Those skilled in the art will quickly appreciate the full useful potential of the present invention in numerous other applications for lapping non-flat surfaces.

As rotatable ball valves have unique spherical geometric characteristics and relationships that have previously limited the required lapping of critical non-flat surfaces to essentially manual operations, it is helpful to review and understand the various lapping problems posed and addressed with the present invention by reviewing the universal or common structure and operating characteristics of rotatable ball valves.

Rotatable ball type valves include a flow containment housing forming a central interior fluid flow passage and have a rotatable ball member disposed in the passage as a fluid flow closure element. The rotatable flow closure element or ball has a flow opening or bore formed therethrough which is rotatably aligned with the central flow passage in the open position to enable virtually unrestricted fluid flow through the valve. The circular valve seat or seats are located to surround this central flow passage and have annular arcuate or spherical sealing surfaces facing the ball. The outer spherical surface of the ball sealingly engages the arcuate shaped face surface of the seat ring or ring carried in the valve housing for forming an annular seal to prevent leakage of fluid therebetween. When the ball is rotated to the closed position or condition for positioning or locating the ball bore traverse to the central flow passage, the annular contact seal formed between the ball and the annular sealing surface serves to block flow of fluid through the valve.

Numerous suitable means are utilized to control or limit rotational ball travel to the quarter turn arc between the aligned or open and traverse or closed positions. Any conventional rotatable ball rotation movement limit stop or indexing arrangement can be provided to limit the rotational operating movement of the ball to the 90 degree or quarter turn arc required while insuring the bore through ball is positioned in the open or closed position. Such indexing stops are needed to prevent throttling flow through the bore of the ball which may occur when the bore is in a partially open position. Such throttled flow damage the sealing surface of the annular seat. See U.S. Pat. No. 3,833,113 to Kolb. This limited ball movement range ensures that the seal is repeatedly effected with an identifiable annular surface zone on one side or hemisphere of the ball when the valve is operated closed. However, the entire hemisphere must be lapped to the mating annular seal surface to prevent damage to the mating seal surfaces during ball rotation.

Examples of quarter turn rotatable ball valves having resilient seal rings forming the primary annular fluid seal are disclosed in the following U.S. Patents:

| U.S. Pat. No. | Patentee |
|---|---|
| 2,963,263 | Sanctuary |
| 3,091,428 | Magos |
| 3,228,652 | Antrim |
| 3,386,699 | Petter et al |
| 3,497,176 | Priese |
| 3,780,985 | Perry |

Examples of quarter turn rotatable ball valves having metal seat rings forming the primary metal-to-metal seal with the outer spherical surface of the ball are disclosed in the following U.S. Patents:

| U.S. Pat. No | Patentee |
|---|---|
| 2,973,182 | Gill |
| 3,036,590 | Knox |
| 3,101,740 | Ray |
| 3,472,270 | Masheder |
| 3,509,913 | Lewis |
| 4,524,946 | Thompson |

While rotatable ball valves may take some or all the form or feature of those embodiments disclosed above, it will be understood by those skilled in the art that the present invention is not limited to any particular type disclosed in those embodiments. Many other known variations or equivalent features in rotatable ball valve construction having the characteristic seal features may be employed. The present invention may be used to form either primary or secondary metal-to-metal seals for any desired embodiment of rotatable ball valves. Indeed, the present invention, while highly suitable for use in forming such metal-to-metal seals, can also be employed for other lapping purposes involving smoothing of non-flat surfaces to a desired surface roughness or providing metal-to-metal sealing of other non-flat surfaces.

To avoid confusion with another known type of ball valve, commonly known as a ball check valve, it is helpful to distinguish these two types of ball valves. The ball check valve employs a solid ball closure element that does not have a bore or flow opening formed therethrough. In operation of ball check valves, the ball is physically spaced, rises from or is physically separated from the annular seat face to enable fluid flow in one direction and moved back into sealing contact with the annular seat when the flow direction reverses. Because the solid ball is uncontrolled in movement the entire outer spherical surface must be mate lapped to the seat. The rotatable ball valve, in contrast, relies on the controlled quarter turn rotary motion of the ball to align the bore formed therethrough with the flow port to enable flow. The outer spherical sealing surface of the solid ball of the ball check valve is continuous or uninterrupted by recesses or openings making it a relatively easy surface to automatically lap as shown and disclosed in the prior art patents. The quarter turn rotatable ball does not have a continuous or uninterrupted outer spherical sealing surface and as a result provides a different and more difficult lapping problem.

The rotatable ball valve movement control or operating mechanism, normally a rotatable stem, effects the quarter turn rotation of the ball to control the position of the bore relative to the central flow passage of the housing. And because the ball movement is controlled to a quarter turn only a hemisphere of the outer surface must be mate lapped to the seat face. To operably connect with the stem, the ball is normally provided with a slot or recess for receiving a connecting blade on the stem. To provide for limited travel or longitudinal "floating" movement of the ball against the seat to insure proper sealing contact pressure therebetween this slot is normally disposed or oriented perpendicular to the axis of the bore of the ball and provided with an appropriate clearance for the stem blade. This slot and the bore openings of the rotatable ball interrupt the continuous outer spherical surface of the ball and limit the use or adaption of apparatus for solid ball lapping to rotatable valves. These universal characteristics or features are universally found or present in any rotatable ball valve.

Illustrated in FIG. 1 is a preferred embodiment of the rotatable ball valve, generally designated V, having a single metal-to-metal primary seal formed in accordance with the present invention. It must be understood that the present invention is not limited to the preferred or any other embodiment of a rotatable ball valve, but may be utilized to surface finish any non-flat surface by lapping.

The valve V includes a valve housing 10, a ball shape closure member 12 and an operating stem 14. The fluid containment housing 10 is preferably formed by a main body or housing 16 and end piece 18. While a two piece end entry type valve housing 10 is described and illustrated those skilled in the art may employ other equivalent valve housing fluid containment structures such as the known three piece construction or a top entry housing. Both the main body 16 and the end piece 18 have an internal, circular cross-section central fluid flow passage 20 formed therethrough in the conventional manner. The longitudinal axis of central flow passage also forms the horizontal longitudinal reference axis X—X of the valve that is also the radius center of the circular cross-section of the flow passage 20. While customarily or commonly identified as the horizontal axis the reference axis X—X may, in practice, extend or be oriented in any desired direction. The main body 16 and the end piece 18 are releasably secured by a suitable plurality of circumferentially spaced body bolting 22 for convenience of assembly and repair in the usual manner. A body seal ring 24 is provided to prevent fluid leakage between the main body 16 and end piece 18 during operation.

The metal ball 12 is rotatably disposed in an enlarged center portion or cavity **20*a* of the flow passage 20 in the usual manner. The ball 12 includes an outer spherical sealing surface 12*a*, a flow port or bore 12*b* formed therethrough and an operating slot or recess 12*c* for co-acting with stem 14. The cross-sectional area of the central bore or flow passage 12*b* of the ball is preferably formed with the same diameter as the bore of the flow passage 20 to provide an unrestricted or unobstructed flow path through the valve V when in the open condition. The longitudinal axis formed by the bore 12*b*** is preferably concentric or aligned with reference axis X—X in the open position and perpendicular thereto in the closed or transverse position. This relationship also places the geometric center of the ball on the axis X—X.

The rotatable stem 14 is suitably journaled or rotatably mounted by the main body 16 and sealed thereto to prevent leakage of fluid by a suitable arrangement such as gland packing 26. The longitudinal rotational axis of stem 14 also defines the reference axis Y—Y of the valve V about which the ball 12 rotates or turns in moving to and from the open and closed positions. The reference axes X—X and Y—Y are disposed perpendicular to each other. For convenience in reference the Y—Y axis is commonly understood to be the vertical reference axis in the same manner as the X—X axis is understood to be the horizontal axis. The geometric center of the ball is preferably also along the axis Y—Y, but in practice there is some limited deviation due to longitudinal or "floating" movement of the ball 12 along axis X—X. In practice neither axis may be disposed in a vertical or horizontal orientation. The upper or exterior end **14*a* of the stem 14 protrudes exteriorly of the valve body 10 to enable operating manipulation of the ball 12 between the open and closed positions. The lower or internal end of the stem 14 is provided with a blade or flat surface arrangement 14***b* that is non-rotatably received within an operating slot 12*c* of the ball 12. The rotation index or movement limit stops for the ball 12 may be suitably formed on either the stem 14 and housing 10 or on the ball 12 and housing 10. Both arrangements are common and well known to those skilled in the art as well as being disclosed in the above listed patents.

In the preferred embodiment, the metal end piece 18 integrally forms the spherical or arcuate seal face surface or annular seal area 28 for establishing the primary metal-to-metal seal with the outer spherical surface 12*a* of the ball 12. If desired a resilient seat ring could be concentrically carried on annular seat 28 to form the primary seal with the metal-to-metal being the secondary seal. The integral spherical shaped seal face surface 28 is preferably lapped to the ball 12 in a manner to be described to effect the primary seal for the valve V. It is to be understood that those skilled in the art may employ or substitute the equivalent means provided by fixed or movable separate seat rings sealingly mounted in the end piece 18 in lieu of the preferred integral construction without departing from the present invention. The integral metal-to-metal valve seat construction is preferred in severe service applications as it entirely eliminates a potential leak path between the separate seat ring and the valve body. Such separate seat rings, if employed, may be fixed or longitudinally movable with respect to the valve body 10 in the manner well known to those skilled in the art.

The valve apparatus V further includes a ball follower or guide 30 which bears against the outer spherical surface 12*a* of the ball 12 but does not normally effect a fluid seal therewith. A biasing spring 32 located between the valve main body 16 and guide 30 urges the guide 30 and ball 12 into sealing contact with the seal face 28. This biasing or urging arrangement insures the desired continuous protective contact or engagement between the seat or seal face surface 28 and the spherical surface 12*a* of the ball 12 at all times.

The operation of the preferred embodiment valve V is accomplished in the usual or conventional manner. Rotation of the journaled stem 14, either manually or by a suitable actuator (not illustrated), effects the limited quarter turn movement of the ball 12 by the non-rotating engagement of the blade 14*b* with the slot 12*c* in the ball 12. Positioning the ball 12 with the bore 12*b* formed therethrough in alignment with the central flow passage 20 or valve axis X—X enables flow through the valve V while rotating the ball a quarter turn to the closed position positions the bore 12*b* of the ball 12 traverse to the flow passage 20 or perpendicular to axis X—X for blocking passage of fluid between the ball 12 and the seat 28. It will be apparent that the seat face 28 contacts only an 180 degree arc or hemisphere of the outer spherical surface 12*a* of the ball 12 during valve operation.

The valve V is normally of the downstream sealing type for providing flow control in a single direction. In other words the desired flow blockage ca be achieved only in preventing flow in the direction to the follower 30 toward the seat 28. Differential fluid pressure effecting flow in a direction from the seat 28 toward the follower 30 will at some value or level compress spring 32 and physically space ball 12 from the seat 28 to enable or permit flow unless follower 30 is designed to act as a seat. Other equivalent valve constructions that provide upstream seat sealing or both upstream and downstream seat sealing are known to those skilled in the art and may be utilized in valve V. Such single direction flow control valves are frequently or commonly called or identified as uni-directional valves in contrast with bi-directional valves that are constructed to control or block flow in either direction. In general, uni-directional valves have a single seat while bi-direction valves have two seats. However, it is known to those skilled in the art that bi-directional flow control can be obtained by arranging in series two uni-directional flow control valves facing in opposite directions.

Referring now to FIGS. 2 and 2A, the relationship of a typical metal rotatable ball closure element 40 with a pair of separate metal seat rings 42 and 44 when in the closed position is illustrated. The spherical closure member or ball 40 is essentially identical to ball 12 and includes an outer spherical sealing surface 40*a*, a flow passage opening or bore 40*b* formed therethrough and a slot 40*c* formed in surface 40*a* for operably receiving the blade of a conventional mating stem (not illustrated) that is similar to blade 14*b* of stem 14. The separate metal seat members or rings 42 and 44 have annular spherical or arcuate seal faces or surfaces 42*a* and 44*a*, respectively, facing the ball 40 and with each face or surface corresponding to integrally formed seal face surface 28. If desired the primary seal may be formed by resilient seat rings 42*b* and 44*b* concentrically carried on seal faces 42*a* and 44*a*, respectively, with the metal-to-metal seal being the secondary or back up seal. The seat rings 42 and 44 are held concentric to the valve horizontal reference axis X—X by a valve body (not illustrated) and may be fixed or longitudinally movable along axis X—X as desired. The seat rings 42 and 44 may be arranged to provide upstream sealing, downstream sealing or both. The longitudinal vertical axis of the rotatable stem (not illustrated) defines the vertical reference axis Y—Y about which the ball 40 rotates a quarter turn in moving between the open and closed positions. To insure accurate positioning or alignment of the bore 40*b*, the ball 40 and/or stem (not shown) rotational travel is limited or indexed to the quarter turn arc about axis Y—Y.

As illustrated in FIG. 2A, this 90 degree ball movement arrangement limits the operating engagement of the seat 42 to a 180 degree arc or hemisphere portion 40*d* of the ball 40 while the seat 44 is similarly limited to engagement with the hemisphere portion 40*e*. Due to this positional relationship it is only necessary to mate lap the annular sealing face 42*a* of seat ring 42 to the outer spherical surface or hemisphere 40*d* to achieve the metal-to-metal seal. Likewise, if seal or seat ring 44 is employed, it is only necessary to lap the hemisphere 40*e* of the ball 40 to the annular sealing face 44*a* to form the metal-to-metal seal. This is commonly known as marrying or mate-lapping of a seat to one side or hemisphere of a ball. By maintaining this dedicated relationship during assembly of the rotatable ball valve the lapping cost involved will be greatly reduced. Such dedicated or mate-lapped surfaces are not considered to be sealingly interchangeable with other balls or seats.

The location of the hemisphere forming bisecting plane P—P illustrated in FIG. 2A is dependent on the particular ball stop arrangement employed and may be adjusted or modified to a different location by those skilled in the art as desired to other arrangements. The ball bisecting plane preferably passes through the geometric center of the ball 40 and is disposed to intersect diametrically opposite edges of the bore 40*b* of the ball 40. Due to the physical relationship and controlled quarter turn operating movement of the ball, a particular seat will only contact or engage a hemisphere portion of the ball.

In viewing FIGS. 2 and 2A, it will also be readily apparent that only annular band or zone B1 on the spherical surface 40*a* of the ball 40 is used to repeatedly form the required closure seal with the arcuate annular seat face 42*a* formed on the seat ring 42 when the ball 40 is in the closed position. The zone B2 on the other side of the ball 40 has the same relationship with seal ring 44. It will be further apparent, that annular sealing bands B1 and B2 are formed on opposite sides of the ball so that band B1 is located on hemisphere 40*d* and band B2 is located on hemisphere 40*e*. It will also be apparent that bands B1 and B2 are not concentrically arranged on hemispheres 40*d* and 40*e*, respectively. This angular offset or eccentric relationship of the bands B1 and B2 to the hemispheres 40*d* and 40*e*, respectively, has provided difficulties in achieving reliable fluid seals by lapping.

The radial or annular width of the bands B1 and B2 is generally formed to be slightly larger than the radial or annular width of the annular faces or seat faces 42*a* and 44*a* due to the small "floating" or longitudinal movement of the ball 40 that prevents exact or precise positioning of the geometric center of the ball 40 on axis Y—Y during every operating cycle. This ball positioning during each operating cycle may also vary as the 90° degree rotation of the ball 40 is not exact or precise. That limited motion is required in actual operation to insure full annular sealing contact of the ball 40 with seats 42 and 44. In theory, it is only necessary to lap the annular bands B1 and B2 with seats 42 and 44 to achieve the metal-to-metal seal. In actual practice it has been found necessary to mate lap a seat face with the entire mated hemisphere to prevent scoring or other damage to the seat face during ball operating movement.

The inner diameter of the effective annular sealing zones B1 and B2 can be no smaller than the inner diameter of the seal rings 42 and 44 due to the absence of physical sealing contact or engagement therebetween. The inner or minimum diameter of the seat rings 42 and 44 are usually established by published industry standards specifying the minimum flow passage through the valve for a particular valve size. For example, published American Petroleum Institute (API) Standard 6D or American National Standards Institute (ANSI) Standard B 16.34 specify such minimum openings.

The large or outer diameter of these effective annular sealing zones B1 and B2 is also usually controlled by these same standards, but for a different reason. These standards do specify the minimum diameter of the cross-sectional flow area of bore 40*b* of the ball 40. When the ball 40 is rotated to the closed position (FIG. 2) the bore 40*b* is disposed traverse or perpendicular to the horizontal central reference axis X—X of the valve V. The portion of the spherical surface 40*a* removed in forming bore 40*b* limits physical sealing contact on the seals 42 and 44 with the ball 40. Thus the diameter of bore 40*b* of the ball 40, by the geometry involved, also physically limits the effective outer diameter of the annular seal zones B1 and B2 as illustrated in FIGS. 2 and 2A.

This geometry also establishes the relationship of the annular zone B1 and B2 to the intersection of reference axes X—X and Y—Y. Normally these annular sealing zones are laid out to be substantially centered on a 45 degree angle from such intersection as disclosed in U.S. Pat. No. 3,784,155 to Tomlin. It is also known to those skilled in the art, that the actual annular sealing contact pressure between a ball and seat within bands B1 and B2 can be controlled or varied by the actual diameters used for forming the seat face.

To summarize, the annular sealing contact between the seat rings 42 and 44 and the spherical surface 40*a* is limited by geometry to the particular annular sealing bands B1 and B2 formed on the ball 40 when the valve is in the closed position. Because the seat rings 42 and 44 surround the central flow passage of the valve, the inner diameter of the seat rings 42 and 44 also establishes the inner or smaller diameter of the sealing bands B1 and B2. The outer diameter of the annular sealing areas B1 and B2 is limited by the relationship of the geometry involved to the diameter of the bore or opening 40*a* through the ball. Furthermore, the bands B1 and B2 are positioned at an angle or eccentric offset to the hemispheres surfaces to be lapped to a particular seat.

Having defined some of the various relationships, factors and considerations of the ball to seat metal-to-metal contact sealing problem for a rotatable ball valve, we turn now to the non-flat surface lapping solution provided by the method and apparatus of the present invention.

The Apparatus

The apparatus A of the present invention is illustrated in FIG. 3 and includes a static structural assembly or support frame, generally designated or referenced as 50, having a base support member or bearing plate 52, an upwardly extending central column or vertical support member 54 and a substantially flat horizontal work table 56 providing an upwardly facing fixed work surface 56*a*. The base plate 52 is fixedly secured or mounted to the foundation F by suitable means such as a plurality of space foundation bolting 58 in the usual or conventional manner. The length of the vertical column 54 fixedly mounted on base member 52 is selected to position the work surface 56*a* at a convenient height for use. The structural frame 50 further includes an upwardly extending vertical arm 60 and a horizontally extending mounting bracket 62 that is disposed or carried by arm 60 above work surface 56*a*. The adjustable height vertical arm 60 is preferably releasably secured to the work table 56 by suitable means such as bolting 64. The height of the telescoping vertical arm 60 for positioning bracket 62 is preferably made adjustable by means of the usual pin and hole arrangement indicated at 60*a*. Preferably, the structural frame 50 is formed by welding of suitable metal materials as will be apparent to those skilled in the art. The arrangement, position, shape, orientation or form of the support frame 50 may be modified by suitable equivalent means known by those skilled in the art without departing from the present invention.

The apparatus A further includes means for securably supporting and rotating a work piece (illustrated in FIG. 3 to be seat ring 42 having the annular spherical seat face or selected surface 42*a* to be lapped) provided by a rotatable turntable 70 carried by or mounted on the output shaft 72*a* of a gearbox 72 mounted or securely positioned on the fixed work surface 56*a*. The right angled gearbox 72 is driven through input shaft 72*b* by a suitable drive or means for effecting controlled rotational movement of the work piece such as operably connected first electric motor 74 which is preferably a reversible variable speed type for controlling both the direction of rotation (clockwise and counter-clockwise) and speed or revolutions per minute (rpm) of the turntable 70 in the conventional manner. The electrical controls for the motor 74 (not illustrated) are well known to those skilled in the art and may be selected from many of the commercial embodiments presently available. If desired those skilled in the art may employ a convention headstock or other equivalent means to support and rotate the work piece.

The apparatus A further includes an adjustable releasable securing jaw or chuck assembly 78 that is carried on the rotatable turntable 70 for releasably holding or securing the work piece (seat ring 42 illustrated) being rotated by the turntable 70 for lapping. The chuck 78 includes a suitable plurality of radially adjustable jaws 78*a* equi-circumferentially spaced on chuck 78 for releasably holding the desired or chosen work piece in the conventional manner (FIGS. 5 and 6). Rotation of the turntable 70 defines a reference rotational lapping axis Z—Z, disposed vertically in the disclosed embodiment, about which chuck 78 will rotate the work piece held or secured thereto by jaws 78*a*. The actual orientation of the lapping axis Z—Z may be varied to any desired orientation from the vertical illustrated by those skilled in the art. The selected surface of the work piece (annular seat face 42*a* illustrated in FIG. 3) to be lapped is concentrically disposed and secured relative to the lapping axis Z—Z in the well known manner. Those skilled in the art may employ any equivalent means, including the above mentioned headstock, for securably supporting and rotating the work piece about the fixed lapping axis Z—Z in the well known manner.

The apparatus A further includes means for non-rotatably holding and moving a lap member L (illustrated as ball 40 in FIG. 3) in lapping contact at a predetermined desired angle with the desired surface of the work piece held on the turntable 70 and the reference lapping axis. By tilting or angling the lap member relative to the lapping axis Z—Z a broader band or zone of surface is lapped in a single revolution of the work piece. This larger contact area speeds the lapping process and enhances the quality of the surface finish obtained.

To achieve this advantage the apparatus A includes a right angle drive gearbox 80 and a second electric motor 82 that are both mounted on the upper bracket 62. The gearbox 80 is preferably driven or powered by the second integral reversible direction, variable speed electric motor 82 having a separate set of suitable electrical controls (not shown) from electric motor 74 for enabling totally independent operation of motors 74 and 82. This enables operation of the motor 82 in both variable speed and direction of rotation to be entirely independent of motor 74. The gearbox 80 includes a rotatable output shaft 80*a* extending downwardly therefrom toward and in concentric alignment with the center of the turntable 70 and lapping axis Z—Z. Both the speed and direction of rotation of the upper output shaft 80*a* and movement of the lap member is controlled by the second motor 82.

As will be detailed, the apparatus A includes means for operably connecting the output shaft 80*a* of the gearbox 80 with a lap member (ball 40 in FIG. 3) positioned in lapping contact with the work piece supported by the chuck 78 on turntable 70. The apparatus A includes an angle adjustment positioning and coupling disk 84 which is releasably secured or concentrically fastened to shaft 80*a* for rotation with shaft 80*a*. The direction of rotation and rotational speed of the disk 84 is also controlled by operation of upper motor 82. As illustrated in FIG. 4 the coupling disk 84 is provided with a plurality of seven openings or holes 84*a–g* formed therethrough that are arranged, distributed or laid out on an increasing spiral helical curve radiating from the center of disk 84. The openings 84*a–g* are equi-angularly spaced relative to the center of disk 84 and shaft 80*a* to provide a dynamic balance when the disk 84 is rotated by motor 82. The radial length spacing or radius distance of each of the openings 84*a–g* from the concentrically secured shaft 80*a* provides an adjustable range of fixed different lapping tilt or angles relative to the rotational axis of shaft 80*a* and concentric aligned axis Z—Z for moving or adjusting the angle of holding the lap member L in lapping contact with the work piece W as will become apparent.

The apparatus A includes a connecting rod, link, shaft or member 88 having an upper portion or end 88*a* that is received in and extends or protrudes through a selected one of the plurality of holes 84*a–g* of the coupling disk 84 and with the lower end secured to the lap member L in a manner to be described. The upper end 88*a* of the straight rod 88 is journaled or received in a selected one of the openings 84*a–g* to enable the rod 88 to freely move longitudinally or rotate in the selected opening in which it is positioned. While the straight rod 88 illustrated is preferred for simplicity and ease of operation, those skilled in the art may modify or utilize a different configuration for the member 88. A biasing spring 90 is concentrically disposed about the rod 88 with the lower end bearing against adjustable nut or spring keeper 92. The spring keeper 92 is adjustably mounted on the rod 88 by a conventional inter-engaged helical set screw or helical thread arrangement to control the tension of the spring 90. The other end of spring 90 bears against the underside of the disk 84 for biasing or urging the rod 88 toward the lap member and providing the desired lapping engagement or contact force of the lap member with the work piece carried by the turntable 70. The spring 90 thus provides and maintains a constant uniform, contact lapping force between the lapping surfaces of the lap member and the work piece that may be conveniently adjusted to vary the lapping contact force as desired.

To provide a desired swinging or oscillating form or type of lapping motion or movement to the lap member relative to the work piece during lapping operations, the apparatus A includes an anti-rotation holder or arm 86 that extends laterally outwardly from the rod 88 or spring keeper 92 for contacting the fixed vertical arm or column 60 to prevent rotation of rod 88 about its longitudinal axis or the lapping angle formed by one of the openings 84*a–g* in disk 84. The holder also serves to prevent or block rotational movement of the lap member about the longitudinal rod 88 or lapping angle formed relative to the reference lapping axis Z—Z at which the lap member is held. The preferred lap angle Q is illustrated in FIG. 7 to be the angle between the reference lap axis Z—Z and the longitudinal axis of the straight rod 88. The optimum or preferred angle for lapping a hemisphere at one time is 45 degrees shown as Q' in FIG. 7. The holder 86 includes a first end or portion 86*a* secured to member 88 and a second end or portion 86*b* that engages or is loosely secured to vertical arm 60 of the support frame 50.

The lower end 88*b* of the rod 88 is fixedly secured to the lap member by a suitable lap holding jig or securing clamp 94 for the part being used as a lap. The specific configuration of clamp 94 may be modified by those skilled in the art while achieving the disclosed purpose and function. In FIGS. 3 and 5, the ball 40 is illustrated as the lap member for mate lapping with the work piece illustrated to be seat 42 (or 44) or end piece 18. As illustrated in the concentric aligned position in FIG. 5, the clamp 94 preferably includes a mounting socket 94*a* for releasably receiving the lower end 88*b* of the rod 88. A conventional perpendicular set screw 94*b* in socket 94*a* is used to releasably secure or mount the lap clamp 94 to the rod 88. The clamp 94 preferably includes a generally C-shaped extension 94*c* that is partially received in the stem slot 40*c* of the ball 40 for securing the ball 40 with clamp 94. If desired, a plurality of small holes may be drilled and tapped at the bottom of the stem slot 40*c* on the ball to receive aligned securing screws (not illustrated) carried by the clamp 94. The non-tilt or angled position of FIG. 5 also illustrates the clearance provided by clamp 94 to enable a sufficient tilt angle to be achieved for lapping an entire hemisphere of ball 40. Other equivalent means or arrangements for securing the rod 88 with the lap member while enabling the desired hemisphere range of movement of the lap member will be known or apparent to those skilled in the art.

The apparatus A further includes a reservoir 96, a controllable pump 97 and supply conduit 98 that are used to provide means to selectively supply the desired lapping fluid to the surface of the work piece and the lap member. The lapping fluid is drawn from the storage reservoir 96 by controlled operation of a suitable pump 97 for discharge into the lapping fluid supply conduit 98 to liberally bathe the work piece and lap by proper positioning of discharge outlet 98*a*. Normally a conventional circulating recycle system (not illustrated) for returning and treating the lapping fluid is utilized to reduce cost. As such supply of cooling and lubricating lapping fluid is well known in the art and included in many types of metal working machinery it is not believed necessary to dwell on the lapping fluid system as a wide range of suitable options are known to and available to those skilled in the art.

The lapping fluid employed may be selected from any one of the types or varieties widely available from numerous commercial sources. The actual type of lapping fluid employed will be determined by the particular or specific lapping operation or task involved. Accordingly, there is no one preferred lapping fluid. Variations in the grain size and hardness of the abrasive or lapping particles suspended in the lapping fluid and other properties of the lapping fluid may be chosen accordingly by those skilled in the art.

The lapping or tilt angle Q which preferably is, but may not be aligned along the longitudinal axis of rod 88 is illustrated in FIG. 7 where it is measured or defined as being between the reference lapping axis Z—Z and the inclination or tilt axis referenced as a—a at which the lap member (ball 40 being so illustrated) is held or secured relative to the work piece. Depending on the form or shape of the non-flat surfaces being lapped the location of the imaginary vertex or intersection of the lapping angle will move along the reference lapping axis Z—Z. With a mating ball 40 and spherical seal faces 42*a* of seat 42 the geometric or radius center of both surfaces will be the same. Since the seal face surface 42*a* is upwardly facing the mating ball 40, the theoretical or imaginary vertex will be located above the lapping contact as illustrated in FIG. 7. If the spherical surface of the seat being lapped is downwardly facing (FIG. 6) the imaginary vertex will be below the lapping contact. Thus, when a ball is the work piece the vertex will be formed at the geometric center of the ball, since the complementary surfaces to be lapped will share substantially the same center. For the smaller size valves it is preferred that the ball be the work piece. For the larger size valves, the ball is preferably employed as the lap member.

In FIGS. 5 and 6 the longitudinal axis of the rod 88 is shown aligned with the lapping axis Z—Z. Lapping with that arrangement will lap a band (B1 or B2) but not a hemisphere of the ball 40. For that reason the tilt or lapping angle of FIG. 7 is employed to position the lap member.

The Method

In practicing the method of the present invention, the part to be lapped that is placed on the lower turntable 70 will be identified as the work piece while the co-acting part placed thereon for effecting lapping will be referred to as the lap or lap member. In FIG. 3, the metal work piece is illustrated as separate seat ring 42 while the lap or lap member is illustrated as ball 40. In FIG. 5, the illustrated lap member is the ball member 12 while the work piece is the housing end piece 18 forming the selected surface 28 while FIG. 6 reverses their lapping position on the apparatus so that the end housing 18 becomes the lap member and the ball 12 is the work piece. It will be understood that the work piece may include one of either the valve end piece housing 18 if an integral seat 28 is being lapped, a seat ring 42 or 44 having seats 42*a* or 44*a*, respectively, a ball closure member 12 or 40 having outer surfaces 12*a* or 40*a*, respectively or any other suitable equivalent metal part to be lapped. It will also be understood that the lap member includes any of the above identified metal work pieces or equivalent metal part and further includes any other special tooling member used for this purpose. If desired the lapping method may be commenced with a special lap member and a mating sealing component substituted during the lapping procedure. It is contemplated that such lap member substitution will be usual procedure during mate lapping, but the present invention is not so limited. Likewise, the selected lap fluid may be changed or varied as desired during use or operation.

Initially, the chosen work piece is operably positioned on the rotatable turntable 70. The work piece is releasably secured to the turntable 70 by jaws 78*a* of chuck or holder 78 after ensuring the desired surface of the work piece to be lapped is concentric with the rotational lapping axis Z—Z.

The lap member is then releasably secured to its holder or clamp 94 and positioned on the desired surface of the work piece. The lower end 88 of the rod 88 is secured to the clamp 94 and alignment of rod 88, the lap member and work piece verified as illustrated in FIGS. 5 and 6. The operator then selects the appropriate tilt or lapping angle by inserting the upper end of rod 88 in one of the openings 84*a–g* of the disk. The anti-rotation arm 86 is fixedly secured to the rod 8 and the spring 90 adjusted to provide the desired lapping pressure or force.

After verification of proper desired alignment of the engaged surfaces to be lapped and proper adjustment of the spring force, the supply of cooling and lubricating lapping fluid having the lapping abrasive is selectively initiated. It is preferable that the supply of lapping fluid be initiated after any alignment or adjustment of apparatus A as any prolonged lapping movement in the absence of the lapping fluid is undesirable as it may result in damage to the mating surfaces from friction or heat generated by that friction.

The lower motor 74 is then preferably placed in operation to rotate the work piece to further verify alignment. Due to the rotary motion of the work piece the lapping operation commences.

At a desired time, the oscillating or swinging motion of the lap member is initiated by starting the upper motor 82 to rotate disk 84. Due to the rotation of the disk 84 mounted on the output shaft 80*a* of the upper gear box the upper end 88*a* of the rod is continuously moved through a circle having a radius determined by selected opening 84*a-g* in which the rod is positioned. As the rod end 88*a* is journaled in the selected opening 84*a-g* the rotational movement of the disk 84 is not imparted to the rod 88 which is also secured or held against rotational movement by the anti-rotation arm 86 engaging arm 60. The resulting motion pattern imparted to the rod 88 is that of the surface of a cone having a vertex aligned or concentric with the vertical reference lapping axis. The surface angle of the cone generated is of course dictated by the radius arm of the opening selected for receiving rod 88 and is the lapping angle Q.

The non-rotating lap member is thus held at a lapping or inclination or tilt angle relative to the reference axis Z—Z and may be revolved, swung or oscillated about the desired surface of the work piece to insure the lapping action covers the entire surface to be lapped.

The resulting movement path of the lap member relative to the surface of the work piece while blocking rotation of the lap member about the longitudinal axis of the rod 88 may be described or characterized in a number of ways. The angled lap member swings about the work piece which can be characterized as an oscillating motion. The plane defined by the rod 88 or selected opening 84*a-g* and the lapping axis may also be described as continuously sweeping about the surface of the work piece to generate a broad band of lapping contact. By changing from time to time the selected opening of the disk 84 receiving the upper end 88*a* of the rod 88 the angular relationship of the lap member and work piece may be varied as desired to insure lapping of an entire hemisphere surface of either the work piece or lap member. This angle adjustment or change may be done periodically and with relative ease during lapping operations.

The timing, direction, speed and sequence of independent operation of the electric motors 74 and 82 to achieve the desired relative lapping movement will be largely at the discretion of the operator of the apparatus A. The operation of the upper motor 82 may be initiated simultaneously with that of the turntable motor 74, but may be deferred for some period of time or omitted altogether. However, it is preferable at some time, usually dictated by the starting or initial roughness of the surface to be lapped, that the upper motor 82 is started first to rotate the disk 84. As explained above, this results in the non-rotating motion of the lap member that has been characterized as oscillating.

From time to time, the operator of the lapping apparatus A may interrupt the lapping operation for various reasons including inspection of progress, adjust tension of spring 90 or change or vary the angle relative to the lapping axis Z—Z at which the lap member oscillates about the work piece. That lapping angle change is easily and rapidly effected by selecting a different one of the openings 84*a-g* in the disk 84 for receiving the upper end 88*a* of the rod 88.

While the operator may chose to do so, it is not necessary to interrupt the lapping process to change either the speed or direction of movement of the work piece or lap members controlled by electric motors 74 and 82.

The above procedures are repeated until the operator is satisfied that the entire desired surfaces have been fully lapped to the specified surface finish. The lapped surface is then inspected to assure compliance with all specifications before assembly.

In the case of mate lapping to achieve a fluid seal by lapping, the mating lap and work piece are assembled and pressure tested to ensure fluid pressure integrity. In the event of leakage, the lapping process is repeated as necessary until the desired fluid seal is obtained.

Each of the United States patents specifically identified in this specification is hereby fully incorporated by this specific reference for forming part of applicant's disclosure as if their entire disclosure was fully set forth in this document.

The foregoing disclosure and description of the invention are illustrative and explanatory thereof, and various changes in the size, shape and materials, as well as in the details of the illustrated construction, may be made without departing from the spirit of the invention.

I claim:

1. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member comprising a ball member for a rotatable ball valve having at least a portion of a spherical outer surface defining a shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lapping contacting said selected surface of said work piece with said shaped lapping surface of said lap member.

2. The apparatus as set forth in claim 1, wherein:

said means for continuously swinging said lap member oscillates said lap member about said selected surface.

3. The apparatus as set forth in claim 1, wherein:

said work piece is a seat ring for a rotatable ball valve and said selected surface is at least a portion of an annular seal face formed by said seat ring.

4. The apparatus as set forth in claim 1, wherein:

said work piece is at least a portion of a flow containment housing of a rotatable ball valve and said selected surface is an integral seal face formed on said body.

5. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member having a shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lappingly contacting said selected surface of said work piece with said shaped lapping surface of said lap member, said means for rotatably supporting said work piece including a rotatable turntable and an adjustable work piece holding chuck mounted on said turntable and rotatable with said turntable;

said means for effecting controlled rotational movement of the work piece including a gear box having an input shaft and an output shaft, said output shaft operably connected with said turntable for effecting rotation of said turntable, and a first electric motor operably connected with said input shaft of said gear box for effecting rotation of said turntable in response to operation of said first electric motor.

6. The apparatus as set forth in claim 5, wherein:

said first electric motor is variable in speed for controlling the rotational speed of said turntable.

7. The apparatus as set forth in claim 5, wherein:

said first electric motor is reversible for controlling the rotational direction of said turntable.

8. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member including at least a portion of a flow housing for a rotatable ball valve having an integral annular seat surface defining a shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lappingly contacting said selected surface of said work piece with said shaped lapping surface of said lap member.

9. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member including a seat ring for a rotatable ball valve having an annular seat surface defining a spherical shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lappingly contacting said selected surface of said work piece with said shaped lapping surface of said lap member.

10. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member having a shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lappingly contacting said selected surface of said work piece with said shaped lapping surface of said lap member;

said means for operably holding said lap member including a connecting member having a first end and a second end, said second end fixedly secured to said lap member; and a restraining member having a first portion and a second portion, said first portion secured to said connecting member and said second portion secured with said support frame to block rotation of said lap member about the predetermined positioning angle.

11. Apparatus adapted for lapping a selected surface of a work piece, including:

a support frame;

a work piece having a selected surface to be lapped;

means, mounted with said support frame, for rotatably supporting said work piece to physically position said selected surface for concentric rotation about a rotational lapping reference axis formed upon rotation of said work piece by said means for rotatably supporting;

means, operably connected with said means for rotatably supporting said work piece, for effecting controlled rotational movement of said work piece;

a lap member having a shaped lapping surface for lappingly contacting said selected surface of said work piece;

means for selectively supplying a lapping fluid carrying abrasive lapping particles to said selected surface of said work piece and said shaped lapping surface of said lap member;

means for operably holding said shaped lapping surface of said lap member on said selected surface at a predetermined positioning angle relative to the lapping axis formed upon rotation of said work piece while blocking rotation of said lap member about the predetermined positioning angle; and means for swinging said lap member about the lapping reference axis while maintaining the predetermined positioning angle for lappingly contacting said selected surface of said work piece with said shaped lapping surface of said lap member;

said means for operably holding said lap member including a connecting member having a first end and a second end, said second end fixedly secured to said lap member;

said means for swinging including a rotatable shaft forming a longitudinal axis concentrically aligned with said rotational lapping axis; means for selectively rotating said shaft; and a disk mounted on said shaft for rotation with said shaft, said disk having at least one opening formed thereon for receiving said first end of said connecting member, said opening disposed a radial distance from said shaft to predetermine the positioning angle of said lap member relative to said lapping axis.

12. The apparatus as set forth in claim 11, wherein said means for selectively rotating said shaft, includes:

a second electric motor operably connected to said shaft for rotating said disk to swing said lap member about the lapping reference axis.

13. The apparatus as set forth in claim 12, wherein:

said second electric motor is reversible in direction to swing the lap member in either direction about the lapping reference axis.

14. The apparatus as set forth in claim 12, wherein:

said second electric motor is variable in speed to control the speed at which the lap member swings about the lapping reference axis.

15. A method of lapping a selected surface formed on a work piece to provide a proper fluid seal including the steps of:

positioning the work piece for concentric rotation of the selected surface about a lapping axis;

placing a lap member having a complementary lapping surface in lapping contact with the selected surface;

rotating the work piece at a desired rotational speed for lapping the selected surface;

holding the lap member to position the complementary lapping surface at a predetermined lapping angle relative to the rotational axis of the lapping axis; and moving the lap member over the selected surface at the predetermined angle while blocking rotation of the lap member about the axis of the lapping angle to provide the proper fluid seal.

16. The method as set forth in claim 15, further including the step of:

adjusting, from time to time, the lapping angle of the lap member to the axis of rotation of the work piece to ensure the entire selected surface is lapped.

17. The method of claim 15, wherein:

the work piece is a seat ring for a rotatable ball valve having an annular spherical sealing surface as the selected surface.

18. The method of claim 15, wherein:

the work piece is a portion of a housing of a rotatable ball valve having an integrally formed annular spherical sealing surface as the selected surface.

19. The method as set forth in claim 15, wherein:

the work piece is a substantially ball shaped flow closure element for a rotatable ball valve having an outer spherical sealing surface as the selected surface.

20. The method as set forth in claim 17, wherein:

the lap member is the flow closure element of the rotatable ball valve for mate lapping of the annular spherical sealing surface of the seat ring to the outer spherical surface of the ball.

21. The method as set forth in claim 18, wherein:

the lap member is the flow closure element of the rotatable ball valve for mate lapping of the annular spherical sealing seat surface of the valve housing to the outer spherical surface of the ball.

22. The method as set forth in claim 19, wherein:

the lap member is a seat ring for a rotatable ball valve.

23. The method as set forth in claim 19, wherein:

the lap member is a portion of the valve housing having an annular seat ring integrally formed thereon.

24. A method of mate lapping a hemispherical surface of a ball member to an annular seat face for forming a metal-to-metal seal for a rotatable ball valve, including the steps of:

rotating the annular seat face concentrically about a reference lapping axis;

placing the seat face in contact with the ball member at a designated location on the spherical surface of the ball;

holding the ball member at a contact angle relative to the reference lapping axis;

urging the seat and ball together with a predetermined lapping force;

applying a lapping compound between the ball and seat while rotating the seat face to achieve the desired metal-to-metal seal between the seat face;

blocking rotation of the ball about the contact angle; and moving the contact angle about the reference lapping axis to impart a swinging contact between the spherical surface of the ball member and the annular seat face.

25. A method of mate lapping a hemispherical surface of a ball member to an annular seat face for forming a metal-to-metal seal for a rotatable ball valve, including the steps of:

rotating the annular seat face concentrically about a reference lapping axis;

placing the seat face in contact with the ball member at a designated location on the spherical surface of the ball;

holding the ball member at a contact angle relative to the reference lapping axis;

urging the seat and ball together with a predetermined lapping force;

applying a lapping compound between the ball and seat while rotating the seat face to achieve the desired metal-to-metal seal between the seat face;

blocking rotation of the ball about the contact angle; and moving the contact angle about the reference lapping axis to impart a swinging contact between the spherical surface of the ball member and the annular seat face.

* * * * *